US009096241B2

(12) United States Patent
Kontetzki

(10) Patent No.: US 9,096,241 B2
(45) Date of Patent: Aug. 4, 2015

(54) DEVICE CARRIER FOR ACTUATING AN ELECTRIC COUPLING AND A CONTROL ELEMENT

(75) Inventor: Arthur Kontetzki, Salzgitter (DE)

(73) Assignee: Voith Turbo Scharfenberg GMBH Co. KG, Salzgitter-Watenstedt (DE)

( * ) Notice: Subject to any disclaimer, the term of this patent is extended or adjusted under 35 U.S.C. 154(b) by 1865 days.

(21) Appl. No.: 11/631,427

(22) PCT Filed: Feb. 27, 2006

(86) PCT No.: PCT/EP2006/001776

§ 371 (c)(1),
(2), (4) Date: Jul. 30, 2009

(87) PCT Pub. No.: WO2006/117036

PCT Pub. Date: Nov. 9, 2006

(65) Prior Publication Data

US 2010/0038334 A1 Feb. 18, 2010

(30) Foreign Application Priority Data

May 4, 2005 (EP) ..... 05009843

(51) Int. Cl.
*B61G 5/06* (2006.01)
*B61G 7/10* (2006.01)

(52) U.S. Cl.
CPC ... *B61G 5/06* (2013.01); *B61G 7/10* (2013.01)

(58) Field of Classification Search
CPC ..... B61G 1/00; B61G 1/13–1/16; B61G 5/06; B61G 5/08; B61G 5/10
USPC ..... 213/1.3, 1.6, 73, 75 R, 76, 77
See application file for complete search history.

(56) References Cited

U.S. PATENT DOCUMENTS

| | | | | |
|---|---|---|---|---|
| 3,249,239 | A * | 5/1966 | Herbert et al. | 213/1.6 |
| 3,591,017 | A * | 7/1971 | Cope et al. | 213/56 |
| 3,717,260 | A * | 2/1973 | Jeffrey et al. | 213/14 |
| 3,899,084 | A * | 8/1975 | Gobrecht et al. | 213/1 R |
| 4,520,662 | A | 6/1985 | Schmid | |
| 5,449,295 | A | 9/1995 | Hanano et al. | |
| 6,474,488 | B1 | 11/2002 | Sullivan | |

FOREIGN PATENT DOCUMENTS

| | | |
|---|---|---|
| DE | 19926058 | 12/2000 |
| GB | 105187 | 4/1917 |
| GB | 105187 A | 4/1917 |

OTHER PUBLICATIONS

International Search Report for PCT Application No. PCT./EP2006/01776, dated Nov. 27, 2006, published by the European Patent Office, 3 pages.

* cited by examiner

*Primary Examiner* — R. J. McCarry, Jr.
(74) *Attorney, Agent, or Firm* — Cesari and McKenna LLP

(57) ABSTRACT

A coupling head with a device carrier for the automatic coupling of couplable vehicles is disclosed, wherein the device carrier comprises a plurality of the components necessary for realizing the automatic coupling and/or decoupling. In order to enable assembly/disassembly of these components on the coupling head which is as simple as possible, the device carrier is disconnectably mounted on the coupling head such that at least one of the components will be activated or deactivated during the coupling and/or decoupling. Also disclosed is a method for assembling a coupling head with a device carrier which comprises a plurality of components necessary for realizing the automatic coupling and/or decoupling.

11 Claims, 3 Drawing Sheets

DEVICE CARRIER FOR ACTUATING AN ELECTRIC COUPLING AND A CONTROL ELEMENT

RELATED APPLICATIONS

The present application is a 371 of International Application No. PCT/EP2006/001776 filed Feb. 27, 2006 by Voith Turbo Scharfenberg GmbH & Co. KG, for a DEVICE CARRIER FOR ACTUATING AN ELECTRIC COUPLING AND A CONTROL ELEMENT, which claims priority to European Application No. 05009843.3 filed on May 4, 2005 by Voith Turbo Scharfenberg GmbH for a Removable Mount For The Operating Devices Of An E-Type Coupler, both of which are hereby incorporated by reference in its entierty.

BACKGROUND OF THE INVENTION

1. Field of the Invention

The present invention relates to a device carrier for a coupling head for the automatic coupling of couplable vehicles, wherein the device carrier comprises a plurality of the components necessary for realizing the automatic coupling and/or decoupling.

Couplings of modern design usually consist of three basic modules. The coupling block is that part which is anchored in the car body of a couplable vehicle. A coupling rod connects the coupling block with the coupling head. The coupling head is the actual active part of a coupling. It ultimately serves in actually producing the operative interaction for coupling the next couplable vehicle. To this end, the coupling head comprises a number of active and passive elements which enable automatic coupling and/or decoupling. The term "coupling" in this regard refers to producing a force-fit connection between the coupling of one couplable vehicle and another coupling of another couplable vehicle. The term "decoupling" is therefore to be understood as the disengaging of such a connection between two adjacent couplable vehicles connected by couplings. The term "coupling procedure" in the following will therefore refer to both coupling as well as decoupling.

The active and passive components which actively or passively support a coupling procedure are auxiliary aggregates which interact with the structural framework of a coupling head. The structural framework of a coupling head in this sense is to be understood as the supporting element for the coupling head. Active or passive components of this type can be, for example, pneumatic valves, hydraulic valves, pneumatic cylinders, hydraulic cylinders, terminal boxes for connecting electrical connections and also connecting rods (actuating mechanisms) for supporting an automatic coupling procedure. The cited components, auxiliary aggregates respectively, must be disposed on the coupling head in order to ensure full functioning.

2. The Prior Art

FIG. 3 shows a solution known from the prior art in which the components necessary to realize the automatic coupling and/or decoupling are individually mounted to the structural framework of the coupling head. In order to achieve an appropriate individual fixing of the components to the coupling head framework, mounting brackets or other mounts 107 are provided at a plurality of different locations. These can either be welded or bolted on or also be cast together with the basic structure of the coupling head. When assembling a complete coupling head it is therefore necessary to position and individually mount each respective component at the respective location provided for same on the coupling head. Due to this individual mounting, assembly entails great effort. In addition, reassembling all the components which have been removed from the coupling head for maintenance purposes when checking the interaction of the components during function testing on a test stand is extremely laborious. For assembly purposes as well as maintenance work, a coupling head of substantially modular configuration would therefore be desirable.

SUMMARY OF THE INVENTION

Based on this problem as set forth, the present invention addresses the task of improving on a coupling head of the type cited at the outset in order to enable simpler assembly/disassembly. A further task of the invention is providing a corresponding method for assembling a coupling head with a device carrier.

This task is solved by the device carrier for a coupling head of the type cited at the outset having the plurality of components necessary for realizing the automatic coupling and/or decoupling being disconnectably mounted on the coupling head such that at least one of the components will be activated or deactivated during coupling and/or decoupling.

The task is furthermore solved by a method for assembling a coupling head. Said method runs through the following steps: first, the components are pre-assembled on the device carrier. These components consist of elements from the group comprised by valves, electrical actuating means, electronic actuating means, terminal boxes, actuating cylinders, actuating mechanisms for the electric coupling and other components required for the functioning of a coupling. The thus fully pre-assembled device carrier is thereafter mounted on the coupling head by means of disconnectable mounting elements such that at least one component can be activated or deactivated during coupling and/or decoupling. Finally, the mechanical, electrical, pneumatic and/or hydraulic connections to the components necessary for the complete functioning of the coupling head are made.

This construction yields considerable advantages with respect to both the assembly of a coupling head as well as the maintenance work necessary on the coupling head. To this end, the device carrier accommodates a plurality of components. These can be terminal boxes, sensors, switches, valves, actuating cylinders, actuating motors as well as actuating mechanisms for the electric coupling. Additional components for the functioning of the coupling head can also be mounted on the device carrier. By so doing, it is no longer necessary to individually mount each respective component on the structural framework of the coupling head. Instead, valves and actuating cylinders, for example, are mounted directly on the device carrier and connected to one another by means of electric, hydraulic or pneumatic lines. The same applies to switches and sensors, their electrical connections fed to a terminal box via cables. The device carrier can furthermore support an actuating mechanism for the electric coupling. Thus, only one hydraulic or pneumatic line and one cable for controlling the components leads off from the fully pre-assembled device carrier. The complete device carrier pre-assembled in this manner can now be fixed to the coupling head, for example with bolts. It can also be removed from the coupling head after disengaging the electric and pneumatic/hydraulic connections. This substantially facilitates the work involved in assembling the coupling head as well as when performing maintenance on the components. It is no longer necessary to individually disassemble the cited components from the device carrier which, in previous assembly methods, were mounted on individual mounting elements on the coupling head.

The method according to the invention represents a particularly simple and economical method of mounting and/or disassembling a plurality of components on a coupling head.

Advantageous further developments of the coupling head according to the invention are given in subclaims 2 to 9.

In one advantageous embodiment, the device carrier is configured such that means configured integral with the device carrier for receiving an actuating mechanism are disposed on at least one of two opposite ends. Conceivable here, for example, would be for the means for receiving the actuating mechanism to be configured as a U-shaped structure, whereby shafts can be mounted between the shanks of this U-shaped structure for accommodating the actuating mechanism for the coupling function. Such shafts would have to be supported without the device carrier of the described type by two separate holding elements provided separately on the coupling head. Of course, it would also be conceivable for the structure to have other forms instead of the U-shaped form or other means for accommodating the actuating mechanism.

One advantageous development of the above-cited embodiment has the means for accommodating the actuating mechanism configured such that in the mounted state, the actuating mechanism is arranged atop or below the device carrier. This enables the actuating mechanism to be arranged at any given position in the two-dimensional coupling plane, which notably results in particularly flexible use of the device carrier with different coupling heads. By having the means for accommodating an actuating mechanism be arranged on one of the two opposite ends on the upper or lower side of the device carrier, it is for example possible to configure said means for accommodating the actuating mechanism as an open-ended structure, whereby the respective openings of the open-ended structure face the direction of coupling, for example. By so doing, auxiliary rods required for activating a function of the coupling and which are supported on the shaft arranged between the shanks of the structure will be afforded unimpeded interaction with the actual closing and opening mechanism of the coupling mechanism for the electric coupling. One conceivable possibility in realizing the open-ended structure might be, for example, a U-shaped configuration. Of course, other forms are just as conceivable here as well. It is also conceivable for at least one of the respective openings of the structure to face outward, inward or rearward.

Advantageous in one of the two latter cited embodiments of the device carrier according to the invention is configuring the means for accommodating the actuating mechanism such that the actuating mechanism for the electric coupling is pivotably supported within the means for accommodating said actuating mechanism in a substantially horizontal plane. This further simplifies mounting and disassembly of the device carrier on the coupling head.

The cited components mounted on the device carrier can consist of a plurality of different auxiliary aggregates which can include valves, electrical actuating means, electronic actuating means, electrical terminal boxes, actuating motors, actuating cylinders and actuating mechanisms for the coupling. What this ultimately means is that all the active and passive elements necessary for the functioning of the coupling head are consolidated on one common device carrier. Individual device carriers on the coupling head for each individual component are therefore no longer necessary. This reduces the complexity to the coupling head.

In one advantageous development of the device carrier, one of the components mounted on the device carrier is an actuating cylinder and/or an actuating mechanism for the coupling head which contributes to the coupling or decoupling. To this end, actuating cylinders and actuating mechanisms for the coupling head can be pre-assembled on the device carrier and interconnected. They are then in place together on the device carrier and can be fitted and removed as a connected unit. The expert will be familiar with further embodiments.

In a further advantageous embodiment of the device carrier according to the invention, a terminal box is also provided on the device carrier. This terminal box can now consolidate all the electrical connections for the components or aggregates on the device carrier. This enables the leading off of only one cable assembly from the device carrier to the coupling box of the couplable vehicle. This one cable assembly can be provided with one connector both to the terminal box on the device carrier as well as a terminal box with connectors for connecting to the couplable vehicle. In this way, the electrical connection to the coupling head can be easily disconnected. This benefits both the assembly as well as maintenance work.

In another embodiment of the device carrier, the actuating cylinder(s) are positioned on the device carrier from below or above when same is in its working position. The interaction of the actuating cylinder with the actuating mechanism, which is held by the means for receiving said actuating mechanism, for example by a shaft in the respective U-shaped configuration at the end of the device carrier, provides a construction which is mechanically elegant, needing only very few additional components. The means for accommodating the actuating mechanism, for example the necessary pushrods, thereby protects the extended actuating cylinder against the effects of dirt or damage.

A further configuration of the coupling head with device carrier according to the invention provides for the device carrier together with the pre-assembled components to be mounted to the coupling head from above. The coupling head is thereby in the working position on the car body of a couplable vehicle. This manner of mounting protects all the components positioned atop the device carrier from contamination which can essentially be conveyed to the coupling head from below. For this reason, valves, electrical and electronic elements and electrical connections are essentially provided atop the device carrier.

BRIEF DESCRIPTION OF THE DRAWINGS

The following will make reference to the figures in describing an embodiment of the invention in greater detail.

Shown are.

DETAILED DESCRIPTION OF AN ILLUSTRATIVE EMBODIMENT

Figure 1:
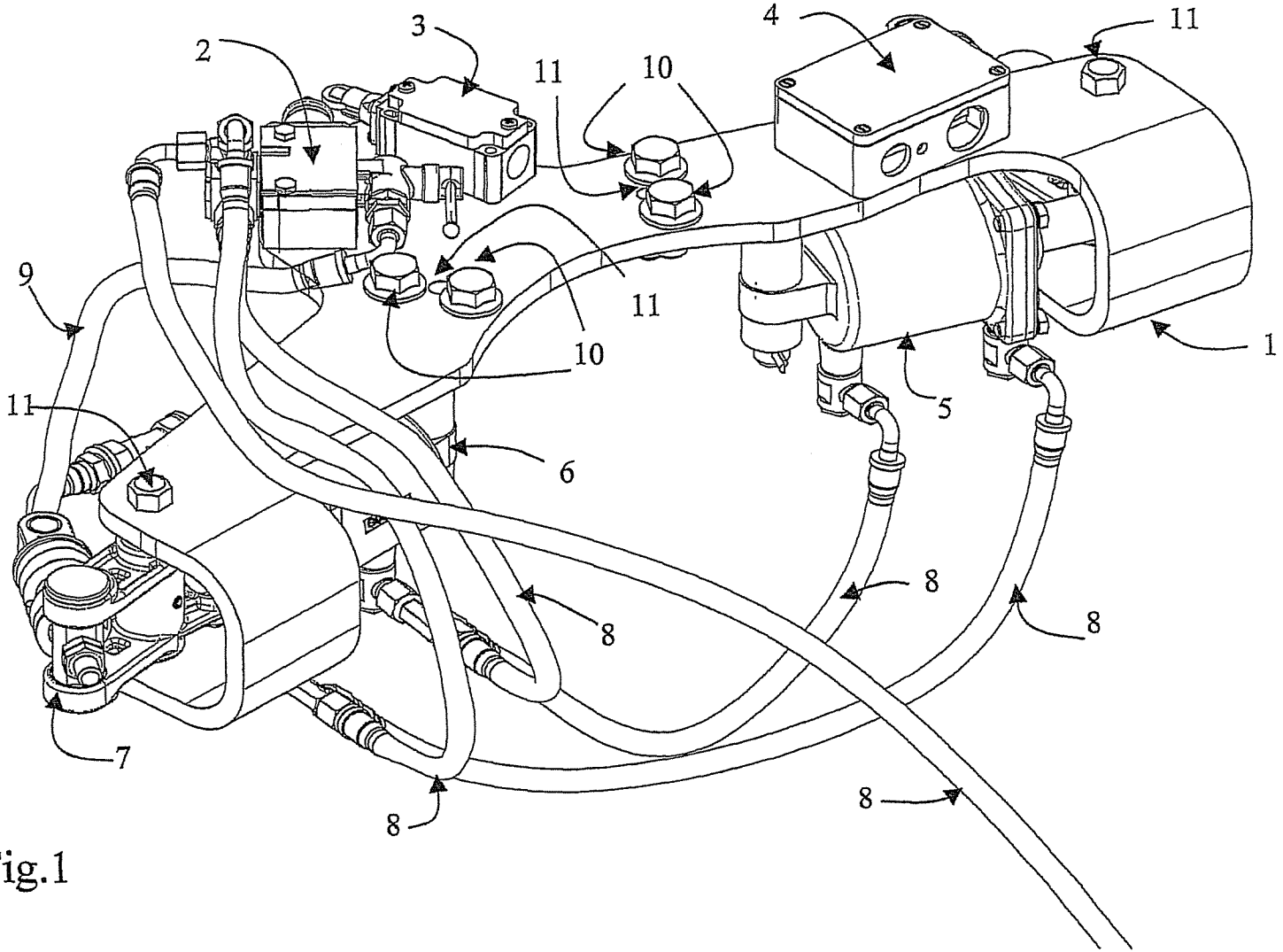
FIG. 1 an assembled device carrier which also includes the components.

FIG. 1 shows the device carrier 1 with mounted components. A yoke-like structure to the device carrier is clearly recognizable. Also recognizable is the construction on the respective ends of the yoke-shaped device carrier 1 for accommodating an actuating mechanism. In the preferred embodiment as shown, this construction is configured as U-shaped structures, whereby other structural designs are, of course, also conceivable. The three-dimensional depiction of the device carrier also allows for recognition of the vertical shafts in the U-shaped molded sections of the device carrier on which the actuating mechanisms 7 for the coupling are pivotably mounted. Actuating cylinders 5 and 6 are mounted underneath and on the device carrier. They can act on the actuating mechanism 7 of the coupling to the right and the left respectively in the means for accommodating the actuating mechanism, the U-shaped sections of the device carrier respectively. Mechanically speaking, this is a very compact construction. Compressed air hoses 8 connected to the actuating cylinders 5 and 6 connect to a pneumatic valve 2 also disposed atop the device carrier 1. Said pneumatic valve 2 is likewise coupled to a compressed air hose. A block switch 3 is further mounted to the forward region of device carrier 1. In this embodiment, same serves for recognizing whether the coupling is in coupled or decoupled state. A terminal box 4 is also depicted on the device carrier 1. All the electrical connections of the coupling head, e.g. also those of switch 3, can be consolidated in this terminal box. One cable assembly can then lead from this terminal box to connect with further electrical connections in the car body of a couplable vehicle. The entire device carrier with all assembled components can be mounted from above to a coupling head 20 by means of bolts 10 and studs 11. It is of course also conceivable for the device carrier to be correspondingly mounted to the coupling head from below.

Figure 2:
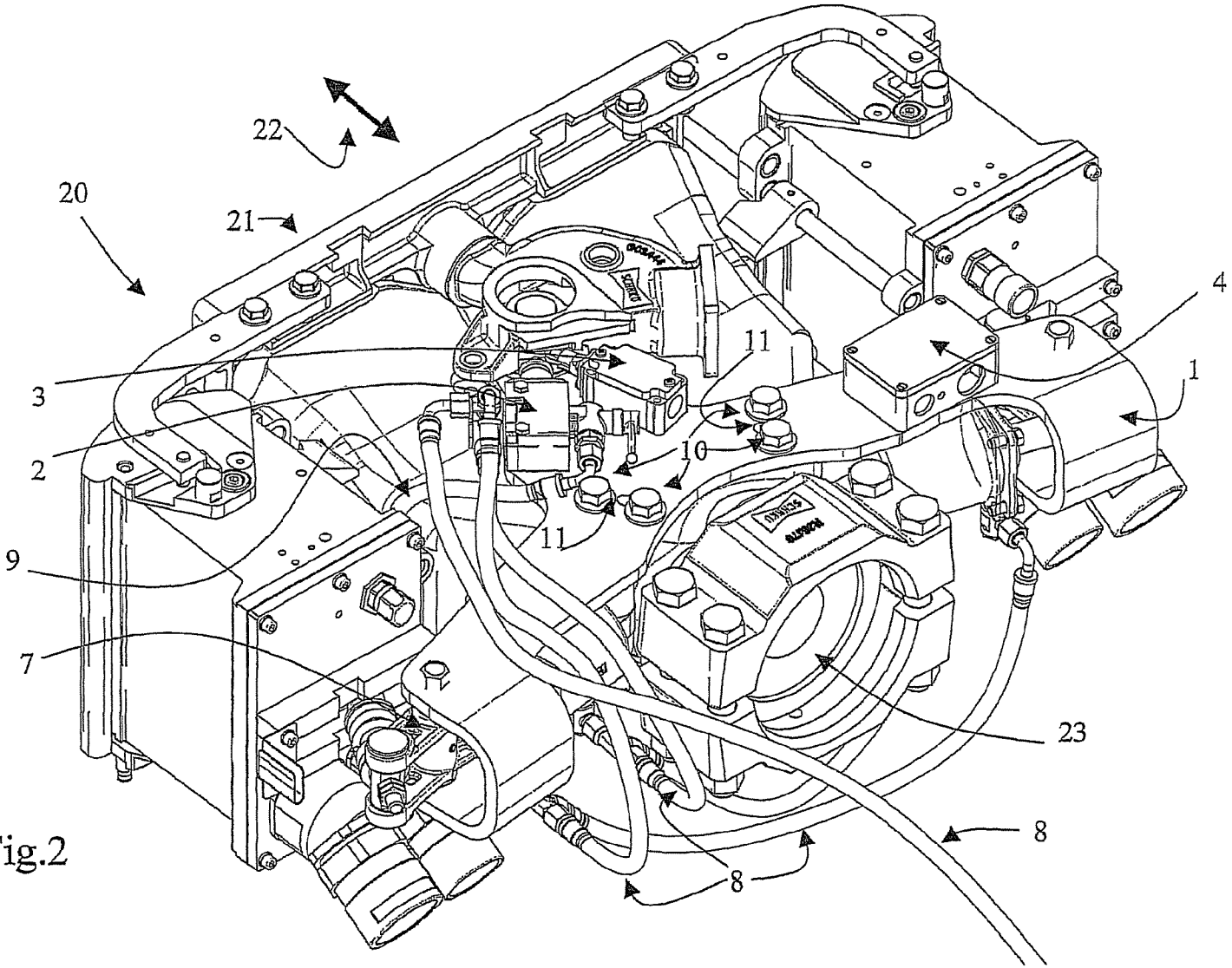
FIG. 2 a coupling head with device carrier exhibiting a plurality of components necessary for realizing the automatic coupling.

FIG. 2 shows the fitted device carrier with all components in the mounted state on a coupling head 20. Also recognizable in this depiction are the individual components such as a valve 2, a switch 3, a terminal box 4, actuating cylinders 5 and 6, an actuating mechanism 7 for the coupling, hoses 8 and 9 as well as the affixing bolts 10 and studs 11 with which the device carrier 1 is mounted to the coupling head 20. The coupling head itself has a coupling plane 21 which is arranged to be perpendicular to the coupling direction 22 in the forward region of the coupling head. Recognizable in the rear region of the coupling head is the adapter chuck 23 for a coupling rod which leads to the coupling block of an aggregate coupling. Clearly depicted is that the device carrier is mounted to the coupling head from above in the rear region of the coupling head. Affixing bolts 10 serve to mount the device carrier 1 to the coupling head 20. Studs 11 serve in the exact fixing of the carrier to or on the coupling head. The expert can easily recognize that the device carrier 1 with all its cited components can be easily removed from the coupling head by disconnecting the mechanical connections to the actuating mechanism as well as the pneumatic and electrical connections by unscrewing the four bolts 10 as depicted for example in FIG. 2. Any other number of bolts is likewise conceivable. Also conceivable is for the device carrier to snap into a retaining profile on the coupling head and thus need only one single bolt to anchor it.

The following will describe the method according to the invention of assembling a coupling head with a device carrier. The actual device carrier 1 is first manufactured from, for example, steel. This device carrier is thereby provided with the necessary bores and threads.

The individual components are thereafter mounted to or on the device carrier. Same normally comprises valves 2, electrical actuating means 3 (such as a block switch, for example), electronic actuating means (not shown), terminal boxes 4, actuating cylinders 5 and 6 for the coupling and other components (not shown) mounted on the device carrier necessary for the function of a coupling. The electrical, pneumatic or hydraulic connections are then made between the components on the device carrier by means of hoses or electrical cables.

Mounting the completely pre-assembled device carrier on the coupling head follows thereafter. This ensues by means of disconnectable fixing means such that at least one of the components is activated or deactivated during coupling and/or decoupling. In the present embodiment these are e.g. the actuating mechanisms 7 for the electric coupling or the block switch 3. The mounting of the device carrier with the fitted components ensues in this embodiment by means of bolts 10, although other mounting options for device carrier 1 to coupling head 20 are also conceivable. For example, the pre-assembled device carrier can also be welded or riveted to the coupling head or be detachably fixed by means of a clamping device. After the device carrier 1 is mounted to the coupling head 20 by means of bolts 10, the mechanical, electrical, pneumatic and/or hydraulic connections necessary for the complete functioning of the coupling head are made. In so doing, the cited components are connected to other functional units of the coupling head 20. Connections to the rest of the couplable vehicle are thereby also made. This would include such connections as the compressed air connection through a pressure hose 9 or also electrical connections which connect at one end to terminal box 4 with the other end being conducted to an electrical terminal box in the car body.

Figure 3:
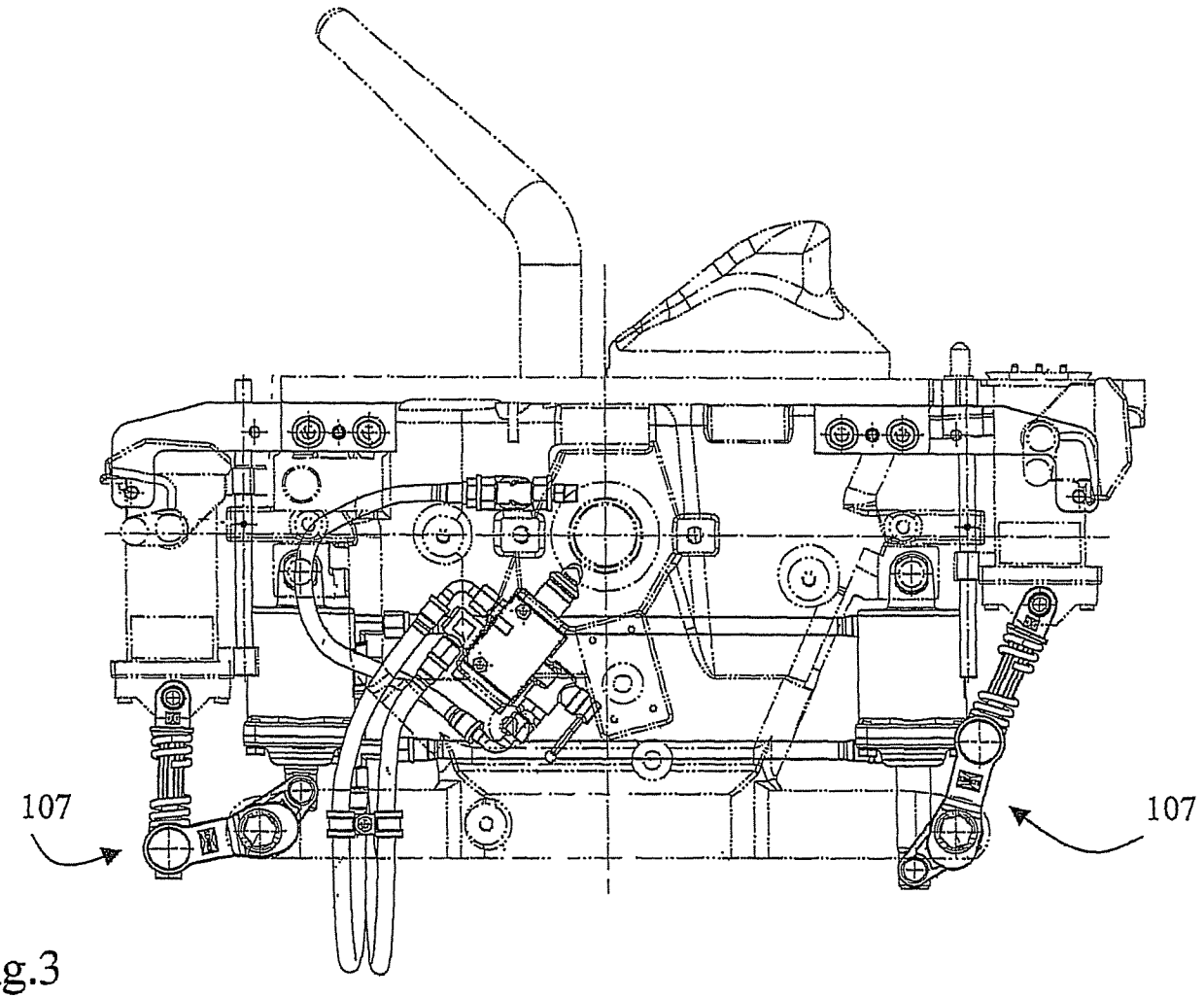
Fig.3 (PRIOR ART)
FIG. 3 a solution known from the prior art which provides for a coupling head without a device carrier.

FIG. 3 shows a solution known in the prior art which provides for a coupling head without a device carrier. As depicted, the components necessary for realizing the automatic coupling and/or decoupling are mounted individually to the structural framework of the coupling head. To this end, mounting brackets or other mounts 107 are provided at a plurality of different locations. These can either be welded or bolted on or also be cast together with the structural framework of the coupling head. When assembling the complete coupling head, this known prior art solution thus requires positioning each respective component at the respective location provided for same on the coupling head and affixing them individually. This individual mounting thus necessitates the expending of great effort during assembly.

The invention claimed is:

1. A coupling head for coupleable vehicles, the coupling head being adapted to perform an operative interaction for coupling to a next coupleable vehicle, the coupling head including a device carrier, the device carrier including at least one active or passive element including an actuating mechanism that is pivotably mounted to the device carrier, the device carrier mounted on the coupling head in a manner such that, during the coupling, the at least one active or passive element is activated, wherein the activation of the at least one active or passive element establishes a force-fit connection in the coupling to the next coupleable vehicle in order to produce the operative interaction.

2. The coupling head according to claim 1, wherein the at least one active or passive element further includes at least one of a pneumatic valve, a hydraulic valve, a pneumatic cylinder, a hydraulic cylinder, and a terminal box for connecting electrical connections.

3. The coupling head according to claim 2, wherein all the electrical connections necessary for the operative interaction are consolidated in the terminal box.

4. The coupling head according to claim 1, wherein the device carrier is configured such that means configured integral with the device carrier for accommodating the actuating mechanism is provided on its at least one of two opposite ends.

5. The coupling head according to claim 4, wherein the means for accommodating the actuating mechanism is configured such that the actuating mechanism is arranged atop or below the device carrier.

6. The coupling head according to claim 5, wherein the actuating mechanism is supported within the means for accommodating said actuating mechanism in a substantially horizontal plane.

7. The coupling head according to claim 4, wherein the actuating mechanism is supported within the means for accommodating said actuating mechanism in a substantially horizontal plane.

8. The coupling head according to claim 1, wherein the actuating mechanism comprises actuating cylinders, and wherein the actuating cylinders are positioned on the device carrier from below or above.

9. The coupling head according to claim 1, wherein the device carrier is mounted from above or below the coupling head fitted in a car body of a coupleable vehicle.

10. A coupling head for coupleable vehicles, the coupling head being adapted to perform an operative interaction for coupling to a next coupleable vehicle, the coupling head including a device carrier, the device carrier including at least one active or passive element including an actuating mechanism that is pivotably mounted to the device carrier, the device carrier mounted on the coupling head in a manner such that, during the coupling, the at least one active or passive element is automatically activated, wherein the automatic activation of the at least one active or passive element establishes a force-fit connection in the coupling to the next coupleable vehicle in order to produce the operative interaction.

11. A method for assembling a coupling head with a device carrier the method comprising:

pre-assembling on the device carrier active or passive elements necessary for the functioning of the coupling head consisting of elements from the group including valves, electrical actuating means, electronic actuating means, terminal boxes, actuating cylinders, and actuating mechanisms that are pivotably mounted to the device carrier for the electric coupling and other elements;

mounting the fully pre-assembled device carrier on the coupling head by means of mounting elements such that at least one of the components is activated during the coupling; and making the mechanical, electrical, pneumatic and/or hydraulic connections to the elements which are necessary for the functioning of the coupling head.

* * * * *

UNITED STATES PATENT AND TRADEMARK OFFICE

CERTIFICATE OF CORRECTION

PATENT NO. : 9,096,241 B2
APPLICATION NO. : 11/631427
DATED : August 4, 2015
INVENTOR(S) : Arthur Kontetzki It is certified that error appears in the above-identified patent and that said Letters Patent is hereby corrected as shown below:

In the Claims:
Claim 11, Col. 8, line 10 should read:
carrier, the method comprising:

Signed and Sealed this
Twelfth Day of January, 2016

Michelle K. Lee

Michelle K. Lee
*Director of the United States Patent and Trademark Office*